US006528934B1

(12) United States Patent
Chen et al.

(10) Patent No.: US 6,528,934 B1
(45) Date of Patent: Mar. 4, 2003

(54) BEAM FORMING REGION FOR ELECTRON GUN

(75) Inventors: Hsing-Yao Chen, Barrington, IL (US); Shunlu Xiao, Beijing (CN)

(73) Assignee: Chunghwa Picture Tubes Ltd., Taoyuan (TW)

( * ) Notice: Subject to any disclaimer, the term of this patent is extended or adjusted under 35 U.S.C. 154(b) by 231 days.

(21) Appl. No.: 09/583,218

(22) Filed: May 30, 2000

(51) Int. Cl.[7] ..... H01J 29/50

(52) U.S. Cl. ..... 313/414; 313/412; 313/413; 313/409

(58) Field of Search ..... 313/414, 412, 313/413, 409

(56) References Cited

U.S. PATENT DOCUMENTS

| | | | | | |
|---|---|---|---|---|---|
| 3,575,733 | A | | 4/1971 | Cecil | 148/1.6 |
| 3,971,860 | A | | 7/1976 | Broers et al. | 427/43 |
| 4,283,483 | A | | 8/1981 | Coane | 430/296 |
| 4,315,984 | A | | 2/1982 | Okazaki et al. | 430/296 |
| 4,323,638 | A | | 4/1982 | Adams et al. | 430/275 |
| 4,329,410 | A | | 5/1982 | Buckley | 430/5 |
| 4,341,850 | A | | 7/1982 | Coane | 430/11 |
| 4,426,584 | A | | 1/1984 | Bohlen et al. | 250/492.2 |
| 4,463,265 | A | | 7/1984 | Owen et al. | 250/492.2 |
| 4,467,026 | A | | 8/1984 | Ogawa | 430/296 |
| 4,520,269 | A | | 5/1985 | Jones | 250/492.2 |
| 4,520,292 | A | * | 5/1985 | van Hekken et al. | 313/412 |
| 4,610,948 | A | | 9/1986 | Glendining | 430/296 |
| 4,957,835 | A | | 9/1990 | Aden | 430/5 |
| 5,008,553 | A | | 4/1991 | Abe | 250/492.2 |
| 5,104,772 | A | | 4/1992 | Kobayashi et al. | 430/296 |
| 5,112,724 | A | | 5/1992 | Bradshaw | 430/296 |
| 5,141,830 | A | | 8/1992 | Komagata | 430/30 |
| 5,198,719 | A | * | 3/1993 | Koh | 313/412 |
| 5,227,269 | A | | 7/1993 | Scott | 430/5 |
| 5,268,258 | A | | 12/1993 | Marks | 430/296 |
| 5,279,925 | A | | 1/1994 | Berger et al. | 430/246 |
| 5,316,879 | A | | 5/1994 | Berger et al. | 430/5 |
| 5,350,967 | A | * | 9/1994 | Chen | 313/412 |
| 5,376,505 | A | | 12/1994 | Berger et al. | 430/296 |
| 5,424,173 | A | | 6/1995 | Wakabayashi et al. | 430/296 |
| 5,459,000 | A | | 10/1995 | Unno | 430/5 |
| 5,478,698 | A | | 12/1995 | Rostoker et al. | 430/296 |
| 5,557,344 | A | * | 9/1996 | Chen | 313/409 |
| 5,593,761 | A | | 1/1997 | Itoh et al. | 428/210 |
| 5,624,774 | A | | 4/1997 | Okino et al. | 430/5 |
| 5,962,963 | A | * | 10/1999 | Hooghordel | 313/412 |

* cited by examiner

*Primary Examiner*—Nimeshkumar D. Patel
*Assistant Examiner*—Matt Hodges
(74) *Attorney, Agent, or Firm*—Emrich & Dithmar

(57) ABSTRACT

An electron gun for use in a cathode ray tube (CRT) includes a source of energetic electrons, i.e., a cathode, a beam forming region for forming the energetic electrons into a narrow beam, an arrangement for deflecting the beam over a display screen, and a focus arrangement for focusing the beam on the display screen in the form of a small spot in forming a video image. The beam forming region includes a G1 control grid, a G2 screen grid and a portion of a G3 grid in facing relation to the G2 grid, where each grid includes a respective aperture through which the electron beam is directed, with the apertures aligned along a common axis. The size of the aperture on the side of the G2 grid in facing relation to the G1 grid forms a first focusing lens and is smaller than the size of the aperture on the opposed side of the G2 grid in facing relation to the G3 grid which forms a second focusing lens. The larger size of the G2 aperture in facing relation to the G3 grid reduces electron beam convergence and spherical aberration of a video image formed by the beam on the display screen. The aperture of the G2 grid may increase in diameter in proceeding from the low side, i.e., the G1 control grid facing side, to the high side, i.e., the G3 grid facing side, in a step-wise manner or in the general shape of a cone. The invention is adapted for use in a single beam projection CRT as well as in a multi-beam color CRT.

6 Claims, 4 Drawing Sheets

BEAM FORMING REGION FOR ELECTRON GUN

FIELD OF THE INVENTION

This invention relates generally to an electron gun such as used in a cathode ray tube for providing a video image on a display screen and is particularly directed to an improved electron beam forming region in an electron gun for reducing spherical aberration in the electron beam and improving video image resolution.

BACKGROUND OF THE INVENTION

Electron guns employed in cathode ray tubes (CRTs) generally can be divided into two basic sections: (1) a beam forming region (BFR) and (2) an electron beam focus lens for focusing the electron beam on the phosphor-bearing screen of the CRT. The electrons emitted from a cathode are directed toward the BFR and formed into a beam bundle and are further directed through a main lens region. The BFR typically is comprised of a G1 control grid, a G2 screen grid and a portion of a G3 grid in facing relation with the G2 screen grid. The energetic electrons are directed through aligned apertures in these three grids and are thereby formed into a well-defined beam having a very small, circular cross section. The beam is focused to a small spot on the CRT's display screen and is deflected in a raster-like manner at very high speeds to form a video image on the display screen. On the case of a color CRT, three electron beams are simultaneously formed, focused, and are converged to a single spot on the display screen. The three electron beams are then displaced in unison in a raster-like manner over the display screen in forming a color video image.

Referring to FIG. 1, there is shown a simplified sectional view of a beam forming region (BFR) 88 in a typical prior art electron gun. BFR 88 includes a cathode 90 which emits energetic electrons along an axis A–A' in the direction of a G1 control grid 92. Axis A–A' represents the longitudinal axis of the electron gun. The energetic electrons are directed through a circular aperture 92*a* in the G1 control grid 92. The energetic electrons then transit an aperture 94*a* in a G2 screen grid 94 and thence are directed through an aperture 96*a* in a G3 grid 96. While the G1 control grid 92 and the G2 screen grid 94 are each typically in the form of a flat plate, the G3 grid is typically tubular in shape and extends to the left of the figure although this is not shown in the figure for simplicity. Thus, element 96 in FIG. 1 represents only the low voltage side of the typical G3 grid.

Each of the G1 control, G2 screen and G3 grids 92, 94 and 96 is charged to a predetermined voltage for forming electrostatic fields through which the energetic electrons are directed for forming the electrons into a narrow beam. The electrostatic field produced by the G2 screen grid 94 in the area of its aperture 94*a* and along axis A–A' is shown by a series of spaced curvilinear lines. These curvilinear lines are known as equipotential lines, each having the same electrostatic potential value along its length. From the figure, it can be seen that the charged G2 control grid 94 forms equipotential lines which bend inwardly toward the center of the grid in the vicinity of its aperture 94*a*. The electrostatic field represented by the field vector $\vec{E}$ applies a force represented by the force vector $\vec{F}$ to an electron where $\vec{F}=-e\vec{E}$, where "e" is the charge of an electron. The electrostatic field and force vectors are oriented perpendicular to the equipotential lines and are opposite in direction. The low voltage side of the G2 screen grid 94, i.e., the portion of the G2 screen grid in facing relation to the G1 control grid 92, operates as a diverging lens. The high voltage side of the G2 screen grid 94, i.e., the portion of the grid in facing relation to the G3 grid, functions as a converging lens to effect electron beam crossover of axis A–A'. This is shown by dotted lines 98 and 100 which represent two electron trajectories in transiting BFR 88. From the figure, it can be seen that as the electron beam transits the electrostatic field of the G2 screen grid 94 in facing relation to the G1 control grid 92, the electrons are directed away from axis A–A' in a diverging manner. The electrons in the beam continue to diverge away from axis A–A' until they encounter the electrostatic field of the G2 screen grid 94 in facing relation to the G3 grid 96, whereupon the electrons are subjected to a converging force which directs the electrons toward axis A–A' as shown on the left side of FIG. 1. The electrons continue to converge toward axis A–A' until they cross over the axis in the focusing region of the electron gun.

The converging electrostatic field of the G2 screen grid 94 in facing relation to the G3 grid 96 exerts a strong converging force on the electron beam as the individual electrons are directed back toward axis A–A'. This strong convergence lens effect on the high side of the G2 screen grid 94 gives rise to spherical aberration of the electron beam and causes a large beam spot on the CRT's display screen and a reduction in video image definition and resolution.

The present invention addresses the aforementioned limitations of the prior art by providing an improved beam forming region for an electron gun which maintains a strong beam divergence effect while at the same time reduces the convergence force applied to the electron beam as it is formed resulting in a corresponding decrease in electron beam spherical aberration and improved definition and resolution of the video image produced by the electron beam.

OBJECTS AND SUMMARY OF THE INVENTION

Accordingly, it is an object of the present invention to provide an improved beam forming region in an electron gun for a cathode ray tube which reduces the spherical aberration of an electron beam on the cathode ray tube's display screen.

It is another object of the present invention to provide in a single- or multi-beam cathode ray tube a variable sized beam, passing aperture in the G2 screen grid of the cathode ray tube's electron gun to maintain strong electron beam divergence while reducing the convergence lens effect on an electron beam produced by the electron gun and the resulting spherical aberration of the final beam spot.

A further object of the present invention is to reduce the strength of an electrostatic convergence lens on an electron beam in the beam forming region of an electron gun in a cathode ray tube.

It is yet another object of the present invention to provide an electron gun incorporating a beam forming region which reduces electron beam spherical aberration for improved video image resolution particularly when used with high electron beam currents as in an electron gun for a projection television receiver.

This invention contemplates a beam forming arrangement in an electron gun for forming energetic electrons provided by a cathode into an elongated beam having a small cross section, the beam forming arrangement comprising a G1 control grid disposed adjacent the cathode and including a first aperture through which the energetic electrons are directed; a lower portion of a G3 grid having a third aperture aligned on a common axis with the first aperture in the G1 control grid; and a G2 screen grid disposed intermediate the G1 control grid and the G3 grid and having a second aperture aligned on the common axis with the first and third apertures, wherein energetic electrons directed through the first aperture transit the second and third apertures in forming a beam of electrons, and wherein the second aperture is defined by a first opening in the G2 screen grid in facing relation to the G1 control grid having a diverging lens effect on the electron beam and a second opposed opening in the G2 screen grid in facing relation to the lower portion of the G3 grid having a converging lens effect on the electron beam, and wherein the second opening is greater than the first opening.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 2:
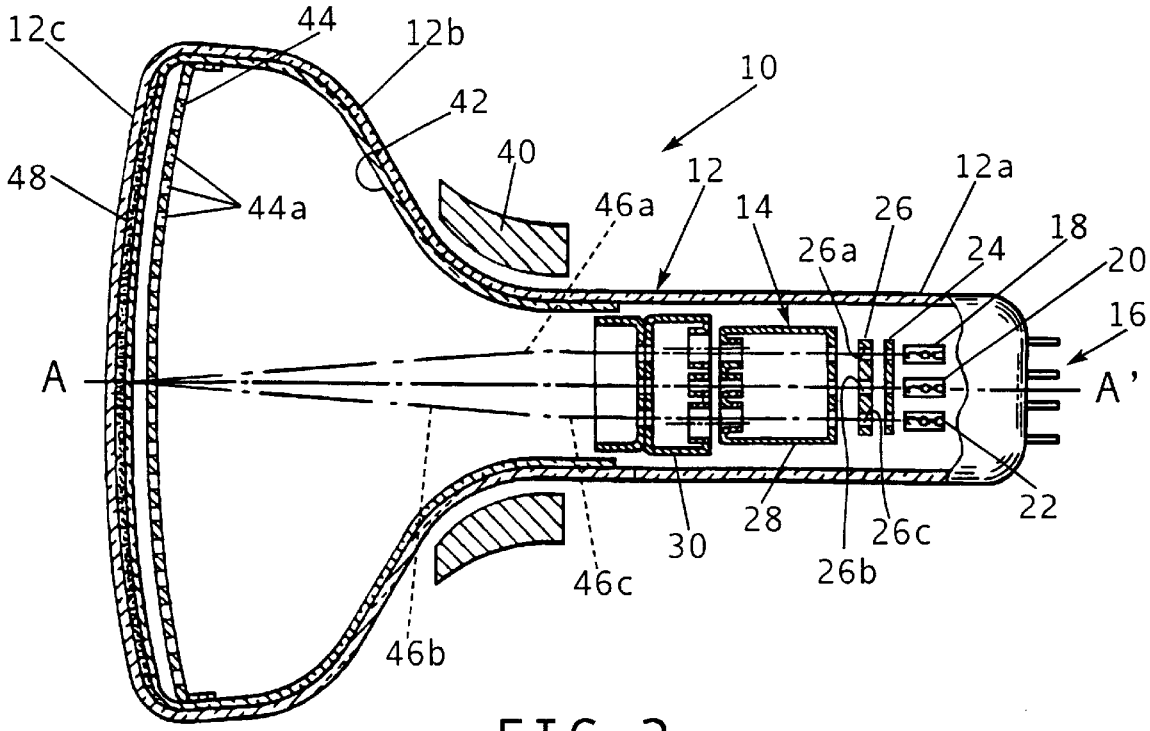
FIG. 2 is a longitudinal sectional view of a cathode ray tube having an electron gun with a beam forming region in accordance with the principles of the present invention.

Referring to FIG. 2, there is shown a longitudinal sectional of a multi-beam color CRT 10 incorporating an electron gun 14 having an improved beam forming region (BFR) in accordance with the present invention. CRT 10 includes a glass envelope 12 having a generally circular cross-section and including a neck portion 12*a*, a funnel portion 12*b* and a display screen, or faceplate, 12*c*. Disposed on the end of the neck portion 12*a* of the glass envelope 12 are plural electrical connecting pins 16 which are connected to an electron gun 14 disposed within the sealed glass envelope 12 for providing power and control inputs to the electron gun. Electron gun 14 includes three inline cathodes 18, 20 and 22 for generating three groups of energetic electrons and directing the electrons through three apertures in a G1 control grid 24. The G1 control grid 24, a G2 screen grid 26 and a facing portion of a G3 grid 28 define the BFR of electron gun 14. Electron gun 14 further includes a high voltage focusing region comprised of the G3 grid 28 and a G4 grid 30. The three inline apertures in each of the aforementioned grids are aligned with a respective one of the cathodes 18, 20 and 22 so as to define three center axes along each of which a respective electron beam is initially directed. The G4 grid 30 is connected to an anode voltage source (not shown for simplicity) by means of a conductive film 42 disposed on the inner surface of the funnel portion 12*b* CRT's glass envelope 12. Three electron beams 46*a*, 46*b* and 46*c* (shown in the figure in dotted line form) are swept in unison across the inner surface of the CRT display screen 12*c* by means of a magnetic deflection yoke 40. Disposed on the inner surface of the display screen 12*c* is a phosphor layer 48 which emits the;three primary colors of red, green and blue when the three electron beams are incident thereon. A charged shadow mask 44 disposed adjacent the CRT's display screen 12*c* and including a large number of apertures 44*a* for passing the electron beams serves as a color selection electrode in permitting each electron beam to be incident upon selected areas of the phosphor layer 48.

Each of the G1 control, G2 screen, G3 and G4 grids is connected to a respective voltage source for forming electrostatic fields in a desired manner along the paths of the three electron beams 46*a*, 46*b* and 46*c* for controlling various parameters of each electron beam. The various voltage sources are not shown in the figure for simplicity and are connected to the grids by means of the aforementioned electrical connecting pins 16. In accordance with one embodiment of the present invention, the three inline beam passing apertures 26*a*, 26*b* and 26*c* in the G2 screen grid 26 provided with a tapered configuration in proceeding opposite to the direction of electron beam travel, i.e., in the direction toward the G1 control grid 24. By providing each of the beam passing apertures 26*a*, 26*b* and 26*c* in the G2 screen grid 26 with a larger end portion in facing relation to the G3 grid 28 and a smaller end portion in facing relation to the G1 control grid 24, the electrostatic lens effect of the G2 screen grid on the electron beams is reduced for reducing the spherical aberration of a video image formed by the electron beams on the CRT's display screen 12*c* as described in greater detail below.

Figure 3:
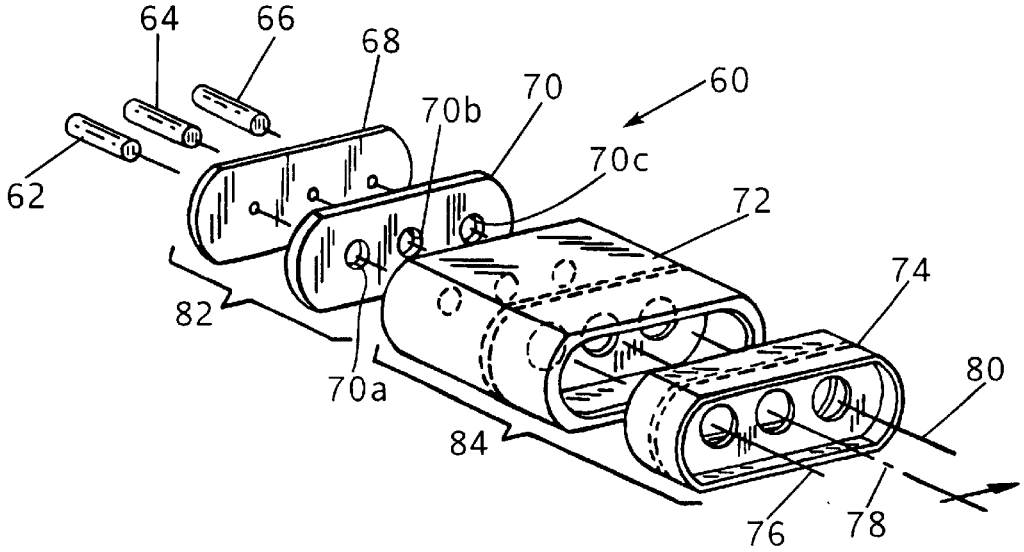
FIG. 3 is a perspective view of another embodiment of an electron gun incorporating a beam forming region in accordance with the present invention.

Referring to FIG. 3, there is shown a perspective view of another embodiment of an electron gun 60 in which the inventive BFR 82 of the present invention can be incorporating. As in the previously described embodiment, electron gun 60 includes three spaced, inline cathodes 62, 64 and 66 which each provide respective pluralities of energetic electrons in the general direction of a G1 control grid 68. The G1 control grid 68 has three spaced, inline apertures through each of which a respective group of energetic electrons is directed. The energetic electrons are directed through the apertures in the G1 control grid 68 and toward a G2 screen grid 70 also having three inline, spaced apertures 70*a*, 70*b* and 70*c*. In accordance with the present invention, each of the three beam passing apertures 70*a*, 70*b* and 70*c* is defined by a smaller opening on the surface of the G2 screen grid 70 in facing relation to a G1 control grid 68 and a larger opening in facing relation to a G3 grid 72. The combination of G1 control grid 68, G2 screen grid 70 and the lower end of the G3 grid 72 forms the electron gun's BFR 82. The electron gun 60 further includes a G4 grid 74 also having three spaced, inline beam passing apertures through which a respective one of the red, green and blue electron beams 76, 78 and 80 (shown in dotted line form) is directed. The high end of the G3 grid 72 and the G4 grid 74 form the electron gun's high voltage focus lens 84.

Figure 1:
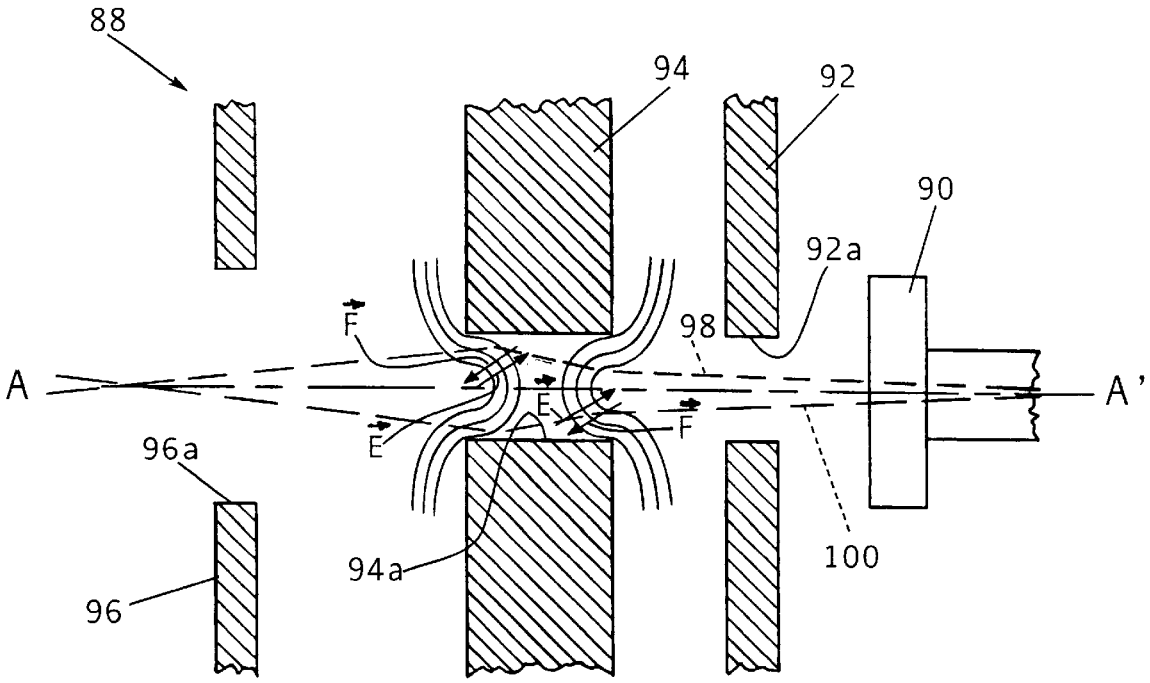
FIG. 1 (PRIOR ART)
FIG. 1 is a simplified sectional view of the beam forming region in a conventional electron gun such as used in a cathode ray tube.
Figure 4:
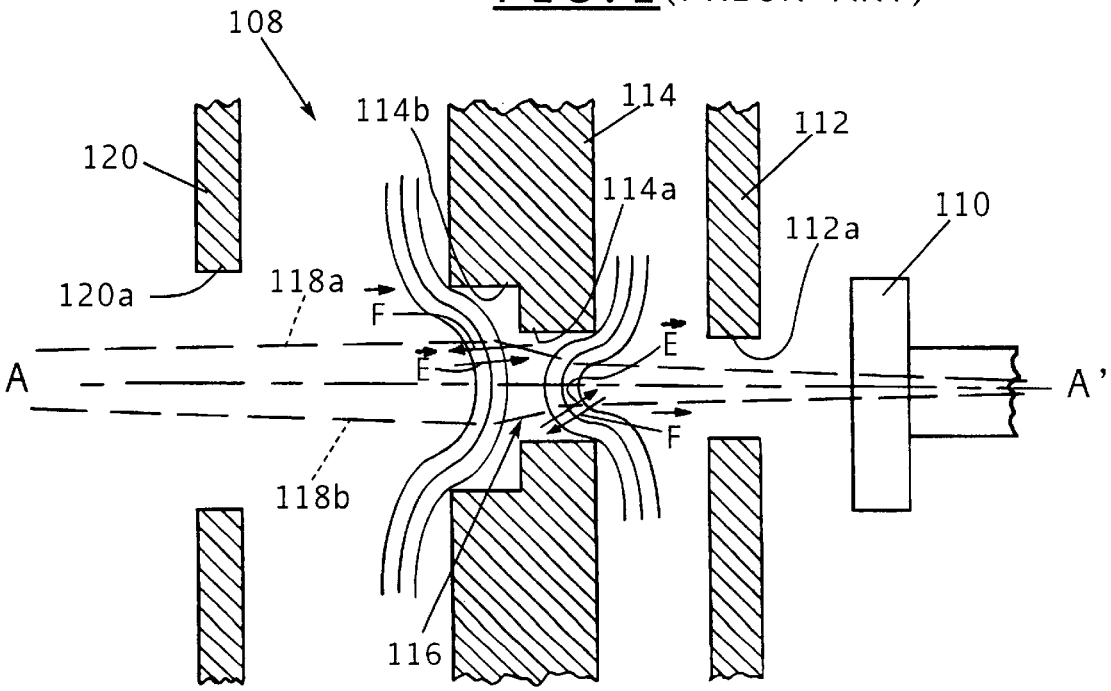
FIG. 4 is a simplified sectional view of the beam forming region of an electron gun in accordance with one embodiment of the present invention.

Referring to FIG. 4, there is shown a simplified sectional view of a beam forming region 108 in accordance with one embodiment of the present invention. BFR 108 includes a cathode 110 which directs energetic electrons through an aperture 112*a* in a G1 control grid 112. The energetic electrons then transit an aperture 116 in a G2 screen grid 114 and are then directed through an aligned aperture 120*a* in a G3 grid 120. FIG. 4 shows the electrostatic field represented by the field vector $\vec{E}$ at both the entrance to and the exit from the aperture 116 in the G2 screen grid 114. The force vector $\vec{F}$ applied to electrons in the beam is also shown at the inlet to and the exit from the aperture 116 in the G2 screen grid 114. As previously described, the electrostatic field and force vectors are generally perpendicular to the equipotential lines. Because at the inlet end of the aperture 116, i.e., the end of the aperture in facing relation to the G1 control grid 112, the G2 screen grid 114 has a diverging lens effect on the electron beam, the electrons are deflected away from axis A–A'. The electrons are then deflected toward axis A–A' by the converging lens effect on the portion of the aperture 116 in the G2 screen grid 114 in facing relation with the G3 grid 120. In accordance with the present invention, the converging lens effect of aperture 116 in the G2 screen grid 114 is reduced by a second aperture portion 114*b* which is larger in diameter than a first aperture portion 114*a* through which the electron beam initially passes in the G2 screen grid. By providing the second aperture portion 114*b* with a larger diameter than that of the first aperture portion 114*a* of aperture 116, the converging lens effect of the aperture on the electron beam is reduced to provide a larger lens diameter and reduced spherical aberration of the electron beam on the CRT's display screen. The reduced convergence effect of the stepped aperture 116 in the G2 screen grid 114 is evidenced by the relative orientations of the electrostatic field vector $\vec{E}$ and the force vector $\vec{F}$ as shown in FIG. 4 when compared with the relative orientation of these vectors on the high side of the G2 screen grid 94 in the prior art BFR 88 shown in FIG. 1. The electrostatic field vector $\vec{E}$ and force vector $\vec{F}$ on the high side of the G2 screen grid 114 in accordance with the present invention are aligned more nearly parallel with axis A–A' than the corresponding vectors in the prior art approach of FIG. 1. By increasing the diameter of the beam passing aperture 116 on the high side of the G2 screen grid 114, the effective diameter of the converging lens is also increased and spherical aberration in the electron beam is reduced.

Figure 5:
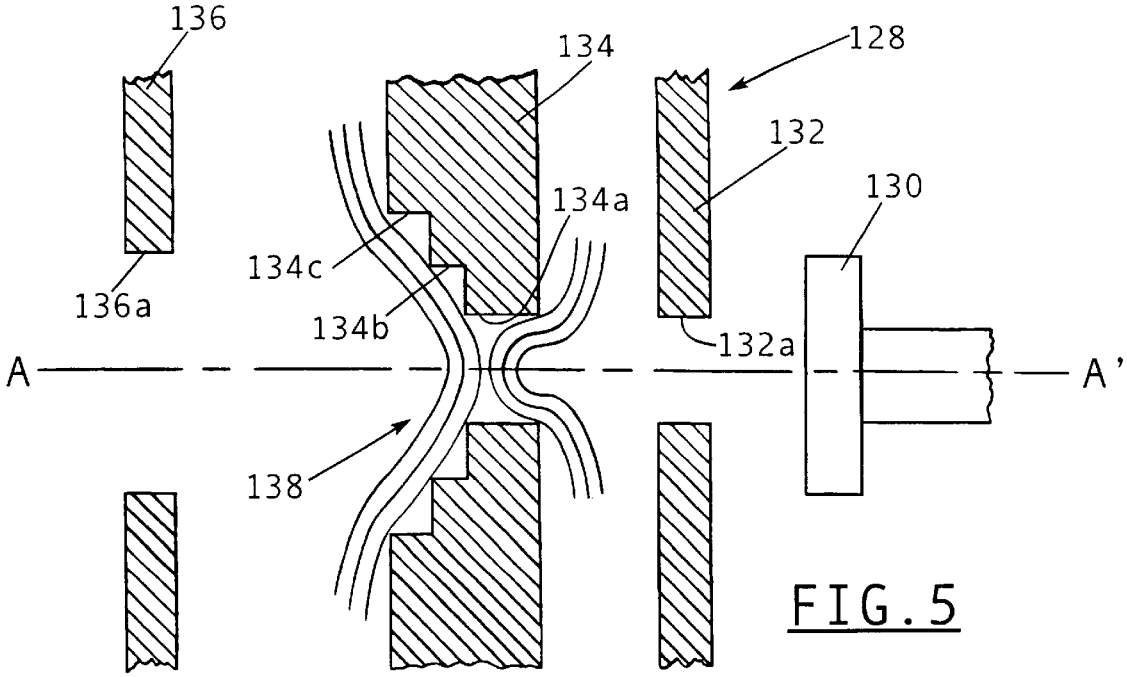
FIG. 5 is a simplified sectional view of another embodiment of a beam forming region for use in an electron gun in accordance with the present invention.

Referring to FIG. 5, there is shown another embodiment of a BFR 128 in accordance with the present invention. As in the previously described embodiments, BFR 128 includes a cathode 130 which directs energetic electrons through an aperture 132*a* in a G1 control grid 132. The electrons in the beam then transit an aperture 138 in a G2 screen grid 134 and an aperture 136*a* in a G3 grid 136. The beam passing aperture 138 of the G2 screen grid 134 is defined by first, second and third aperture portions 134*a*, 134*b*, and 134*c*. The three aperture portions 134*a*, 134*b* and 134*c* are of increasing diameter in proceeding toward the G3 grid 136. The increasing diameters of the three aperture portions 134*a*, 134*b*, and 134*c* form the a multi-step aperture 138 within the G2 screen grid 134 for reducing the convergence lens effect on the electron beam of the high side of the G2 screen grid 134 which is in facing relation with the G3 grid 136. This decreased convergence effect of the high side of the beam passing aperture 138 in the G2 screen grid 134 is caused by forming the electrostatic equipotential lines more perpendicular to axis A–A' adjacent the high side of the G2 screen grid. The effect of reducing the convergence lens effect on the electron beam passing aperture 138 is to also reduce spherical aberration of the beam as it is incident upon the CRT's display screen.

Figure 6:
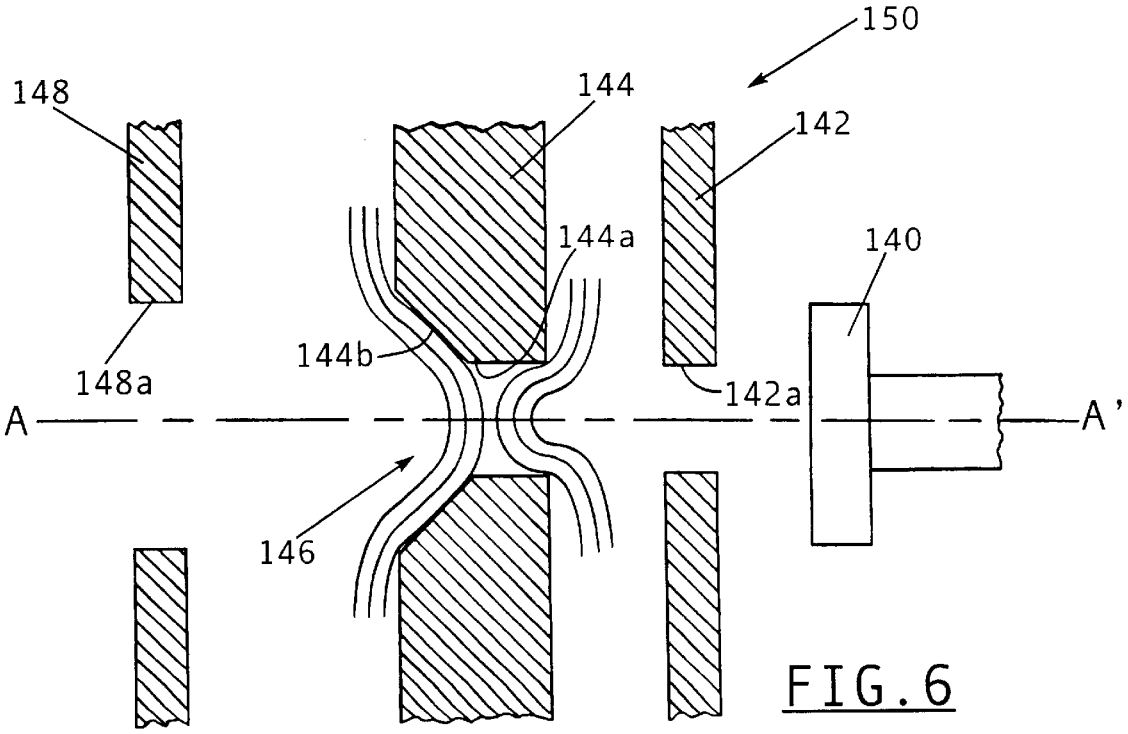
FIG. 6 is a simplified sectional view of yet another embodiment of a beam forming region for use in an electron gun in accordance with the principles of the present invention.

Referring to FIG. 6, there is shown another embodiment of a BFR 150 in accordance with the present invention. As in the previously described embodiments, a cathode 140 directs energetic electrons through an aligned aperture 142*a* in a G1 control grid 142, aperture 146 in a G2 screen grid 144, and aperture 148*a* in a G3 grid 148, where the three apertures are disposed on and aligned with axis A–A'. Aperture 146 in the G2 screen grid 144 is formed by first and second aperture portions 144*a* and 144*b*. The first aperture portion 144*a* is in facing relation to the G1 control grid 142, while the second aperture portion 144*b* is in facing relation with the G3 grid 148. The first aperture portion 144*a* is cylindrical in shape, while the second aperture portion 144*b* is conical, or tapered, in shape. The larger end of the tapered second aperture portion 144*b* is in facing relation with the G3 grid 148, while the smaller end of the second tapered aperture portion forms an inner portion of the G2 screen grid 144. As in the previously described embodiments, the second tapered aperture portion 144*b* of aperture 146 in the G2 screen grid 144 reduces the convergence lens effect of the G2 screen grid on the electron beam, resulting in a corresponding reduction in spherical aberration of the beam on the CRT's display screen.

Figure 7:
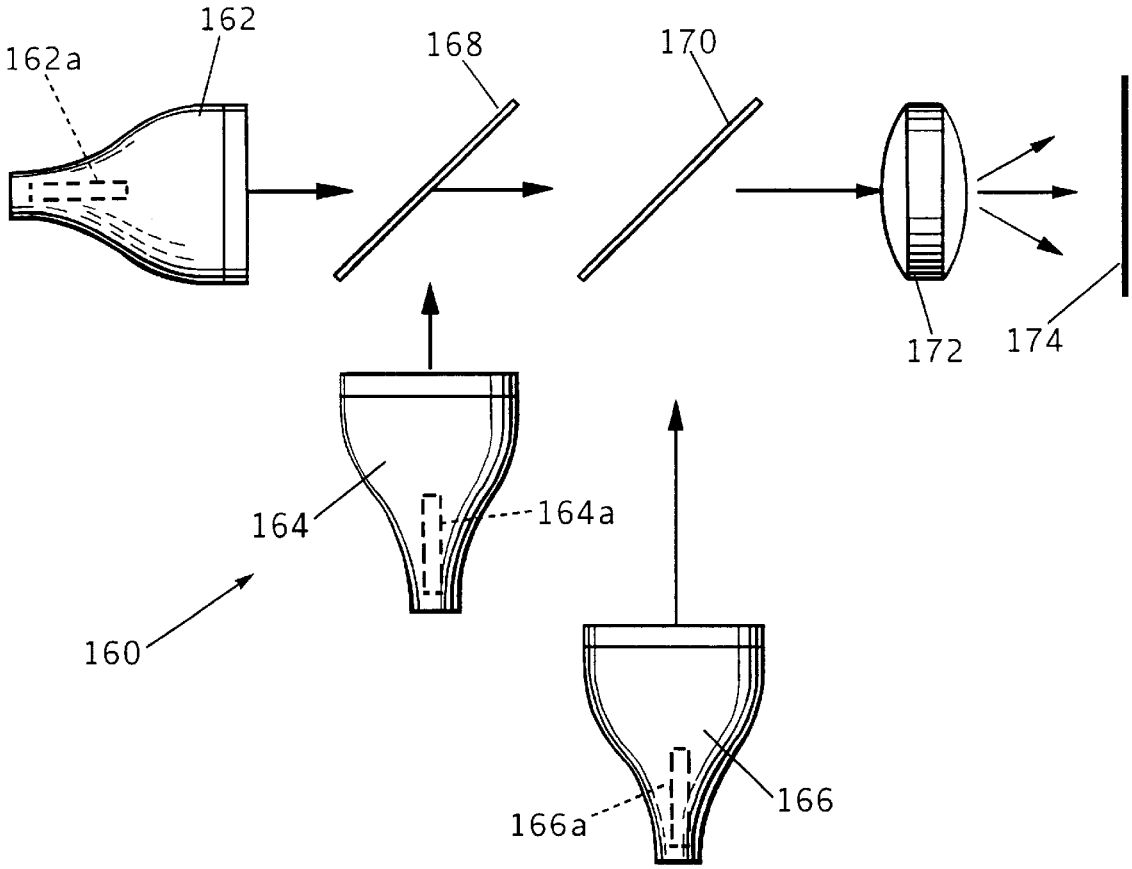
FIG. 7 is a simplified schematic diagram of a projection television receiver incorporating an electron gun having an improved beam forming region in accordance with the present invention.

Referring to FIG. 7, there is shown a simplified schematic diagram of the relevant portion of a projection television receiver 160 incorporating plural electron guns each having an improved beam forming region in accordance with the present invention. Projection television receiver 160 includes red, green and blue CRT's 162, 164 and 166. Each of the CRTs includes a respective electron gun incorporating an improved beam forming region as previously described in accordance with the present invention. Thus, the red CRT 162 includes electron gun 162*a*, the green CRT 164 includes electron gun 164*a*, and the blue CRT 166 includes electron gun 166*a*. The projection television receiver 160 further includes first and second dichroic mirrors 168 and 170. The first dichroic mirror 168 transmits the red image from the red CRT 162. The first dichroic mirror 168 also reflects the green image emitted by the green CRT 164. The second dichroic mirror 170 transmits both the red and green images, and also reflects the blue image emitted by the blue CRT 166. The first and second dichroic mirrors 168, 170 are oriented with respect to the red, green and blue CRTs 162, 164 and 166 such that the three video images are directed through a single projection lens 172 to screen 174 on which the color video image is presented. Projection television receiver 160 is shown in FIG. 7 in simplified form, it being understood that other elements and components well known to those skilled in the relevant arts would typically be incorporated in a projection television receiver, but that these other elements and components have been omitted from the figure for simplicity as they are not involved with or relate to the use of an inventive electron gun incorporating the novel electron beam forming region of the present invention.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A beam forming arrangement in an electron gun for forming energetic electrons provided by a cathode into an elongated beam having a small cross section, said beam forming arrangement comprising:

a G1 control grid disposed adjacent the cathode and including a first aperture through which the energetic electrons are directed;

a lower portion of a G3 grid having a second aperture aligned on a common axis with the first aperture in said G1 control grid; and a generally flat G2 screen grid disposed intermediate said G1 control grid and said G3 grid and having a third aperture aligned on said common axis with said first and second apertures, wherein energetic electrons directed through said first aperture transit said second and third apertures in forming a beam of electrons, and wherein said third aperture is defined by a first cylindrical input aperture portion in a first generally flat single wall of said G2 screen grid in facing relation to said G1 control grid having a diverging lens effect on the electron beam and a second cylindrical output aperture portion in a second opposed generally flat single wall of said G2 screen grid in facing relation to the lower portion of said G3 grid having a converging lens effect on the electron beam, and wherein said first and second opposed walls are generally parallel and said second cylindrical output aperture portion is greater in diameter than said first cylindrical input aperture portion, and wherein said first and second cylindrical portions are aligned along a common axis and have approximately the same depth in said G2 screen grid.

2. The beam forming arrangement of claim 1 wherein said third aperture is defined by a first cylindrical portion in facing relation to said G1 control grid and a second tapered portion in facing relation to the lower portion of said G3 grid, said second tapered portion including a first smaller end disposed adjacent said first cylindrical portion of said third aperture and a second opposed, larger end disposed in facing relation with the lower portion of said G3 grid.

3. The beam forming arrangement of claim 1 wherein said third aperture is defined by a first cylindrical aperture portion disposed in facing relation to said G1 control grid and having a first diameter, a second cylindrical aperture portion disposed in facing relation to the lower portion of said G3 grid and having a second diameter, and a third cylindrical aperture portion disposed intermediate said first and second cylindrical aperture portions and having a third diameter, and wherein said third diameter is greater than said first diameter and said second diameter is greater than said third diameter.

4. For use in a cathode ray tube having a sealed glass envelope with a display screen disposed on an inner forward portion of said glass envelope, an electron gun for forming a video image on said display screen, wherein said cathode ray tube is incorporated in a projection television receiver, said electron gun comprising:

a cathode for providing energetic electrons;

a beam forming region disposed adjacent said cathode for forming the electrons into an elongated beam having a small cross section;

an electrostatic lens for focusing the beam of electrons on the display screen;

a magnetic deflection arrangement for deflecting the beam of electrons over the display screen in a raster-like manner for forming a video image on the display screen; and wherein said beam forming region includes a charged grid having an aperture therein and wherein the electron beam is directed through said aperture, wherein an input portion of said aperture in facing relation to said cathode applies a diverging lens effect on the electron beam and an output portion of said aperture in facing relation to said electrostatic lens applies a converging lens effect on the electron beam, and wherein said converging lens effect is greater than said diverging lens effect; and wherein said aperture is defined by a first cylindrical input aperture portion in facing relation with said cathode and a second cylindrical output aperture portion in facing relation with said electrostatic lens, and wherein said second cylindrical output aperture portion has a larger diameter than said first cylindrical input aperture portion, and wherein said first cylindrical input and second cylindrical output portions are aligned along a common axis and have approximately the same depth in said charged grid.

5. The electron gun of claim 4 wherein said aperture is defined by a first cylindrical input portion in facing relation to said cathode and a second tapered output portion in facing relation to said electrostatic lens, said second tapered portion including a first smaller end disposed adjacent said first cylindrical input portion of said aperture and a second opposed, larger end disposed in facing relation with said electrostatic lens.

6. The electron gun of claim 4 wherein said aperture is defined by a first cylindrical input aperture portion disposed in facing relation to said cathode and having a first diameter, a second cylindrical output aperture portion disposed in facing relation to said electrostatic lens and having a second diameter, and a third cylindrical aperture portion disposed intermediate said first cylindrical input and second cylindrical output aperture portions and having a third diameter, and wherein said third diameter is greater than said first diameter and said second diameter is greater than said third diameter.

* * * * *